US007275567B2

(12) United States Patent
Ishii et al.

(10) Patent No.: US 7,275,567 B2
(45) Date of Patent: Oct. 2, 2007

(54) REINFORCING BAR BINDING MACHINE

(75) Inventors: Syuichi Ishii, Tokyo (JP); Shinichi Ohkubo, Tokyo (JP); Osamu Itagaki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 599 days.

(21) Appl. No.: 10/507,430

(22) PCT Filed: Mar. 7, 2003

(86) PCT No.: PCT/JP03/02742

§ 371 (c)(1),
(2), (4) Date: Sep. 10, 2004

(87) PCT Pub. No.: WO03/080445

PCT Pub. Date: Oct. 2, 2003

(65) Prior Publication Data

US 2005/0224131 A1 Oct. 13, 2005

(30) Foreign Application Priority Data

Mar. 12, 2002 (JP) ..... 2002-067449

(51) Int. Cl.
*B21G 3/00* (2006.01)

(52) U.S. Cl. ..... 140/119; 140/93.6; 140/102

(58) Field of Classification Search ..... 140/93.2, 140/93.4, 93.6, 57, 102, 118, 119, 149; 100/29, 100/31, 32

See application file for complete search history.

(56) References Cited

U.S. PATENT DOCUMENTS 4,252,157 A * 2/1981 Ohnishi ..... 140/93 A
4,494,580 A * 1/1985 Loustau ..... 140/1
4,498,379 A * 2/1985 Saylor ..... 100/2
4,865,087 A 9/1989 Geiger ..... 140/119
5,279,336 A 1/1994 Kusakari et al. ..... 140/57
5,947,166 A * 9/1999 Doyle et al. ..... 140/119
7,051,650 B2 * 5/2006 Kusakari et al. ..... 100/31
7,143,792 B2 * 12/2006 Ishikawa et al. ..... 140/119
2005/0005991 A1 * 1/2005 Ishikawa et al. ..... 140/119
2006/0011254 A1 * 1/2006 Yokochi et al. ..... 140/119

FOREIGN PATENT DOCUMENTS

EP 0 810 153 A1 12/1997
JP 6-135411 A 5/1994
JP 10250703 9/1997

* cited by examiner

*Primary Examiner*—Ed Tolan
(74) *Attorney, Agent, or Firm*—Morgan, Lewis & Bockius LLP

(57) ABSTRACT

A front end of a loop of a wire fed out to a nose (6) by a binding wire feeding mechanism (1) is pinched by a clamp plate (28) of a binding wire clamping apparatus (25) and the wire is pulled back by driving to rotate reversely a feeding motor (13) of the binding wire feeding mechanism (1). When the wire is brought into close contact with a reinforcing bar (S) and a load of the feeding motor is increased to thereby increase a drive current by a constant amount, a control apparatus stops the feeding motor. Thereafter, the binding wire clamping apparatus (25) is rotated to twist the binding wire to bind the reinforcing bar. Since the wire is pulled back and a length of the wire is automatically adjusted in accordance with a diameter of the reinforcing bar, a state of finishing to bind the reinforcing bar is made to be uniform and also an amount of consuming the wire is reduced.

10 Claims, 18 Drawing Sheets

21
22
23
24
25
26
27
28
29
30
31
32
33
34
39
4
5
6
8
9
10
11
13
S
W 21
22
23
24
32
30
29
27
28
39
26
33
34
31
13
8
9
S
6
W
4
5
11
10

21
22
23
24
26
27
28
29
30
31
32
33
34
4
5
6
8
9
10
11
13
S
W

REINFORCING BAR BINDING MACHINE

This application is a 35 USC 371 of PCT/JP03/02742 filed Mar. 7, 2003.

TECHNICAL FIELD

The present invention relates to a reinforcing bar binding machine, and particularly relates to a reinforcing bar binding machine constituted to pertinently control a length of a binding wire in accordance with a diameter of a reinforcing bar.

BACKGROUND ART

According to a reinforcing bar binding machine of a background art for binding a reinforcing bars by feeding a binding wire to form a binding wire loop around the reinforcing bars and thereafter twisting the binding wire loop to bind the reinforcing bars, the binding wire is wound around the reinforcing bars by two or more turns to bind and therefore, there poses a problem that an amount of consuming the binding wire is large. Further, since an amount of feeding the binding wire is constant, when a diameter of the reinforcing bar is slender, an amount of twisting the binding wire is increased, a length of a twisted portion is prolonged and therefore, when concrete is cast thereto, the binding wire is projected from a surface of concrete and a problem may be posed in a finishing.

In order to resolve the above-described drawback, the applicant has already proposed a reinforcing bar binding machine constituted such that one turn of a binding loop is formed by a binding wire feeding mechanism, a front of a binding wire is held by a clamping mechanism and thereafter, a loop diameter of the binding wire is contracted by reversely rotating a motor for feeding the binding wire and thereafter, the binding wire is twisted to bind. However, there are various boldnesses in the reinforcing bar and a pertinent pull back amount is not constant. Therefore, when the pull back amount is constituted to control in accordance with a diameter of the reinforcing bar, the binding can further uniformly be finished. As pull back amount controlling means, an amount of reversely rotating a motor for feeding the binding wire may be adjusted by adjusting means of a dial, a key switch or the like, however, such an manual adjusting means is difficult to set pertinently, further, the amount needs to be adjusted each time in accordance with the reinforcing bar diameter, and therefore, this is not efficient.

DISCLOSURE OF THE INVENTION

Hence, there is posed a technical problem to be resolved in order to achieve constant finishing regardless of a diameter of a reinforcing bar by automatically controlling an amount of pulling back a binding wire in accordance with the diameter of the reinforcing bar and it is an object of the invention to resolve the above-described problem.

The invention is proposed in order to achieve the above-described object and provide a reinforcing bar binding machine which is a reinforcing bar binding machine for forming a loop at a surrounding of reinforcing bars by feeding out a binding wire by a binding wire feeding mechanism, clamping a front of the binding wire by a clamping mechanism, pulling back the binding wire by driving to rotate reversely the binding wire feeding mechanism to wind around the reinforcing bars and twisting the binding wire by driving to rotate the clamping mechanism to bind the reinforcing bar, wherein the reinforcing bar binding machine is provided with a circuit of detecting a current for driving a feeding motor of the binding wire feeding mechanism, measures the current for driving the feeding motor successively at each unit time in a step of pulling back the binding wire and is provided with a control portion (controlling means) for stopping the feeding motor when a newest measured value is increased more than a lowest value in the measured value by a predetermined amount.

Further, the invention provides the reinforcing bar binding machine provided with means for detecting an amount of pulling back the binding wire in addition to the above-described constitution and is provided with a control portion (controlling means) for stopping the feeding motor when an amount of pulling back the binding wire reaches a reference value in the step of pulling back the binding wire.

Figure 1:
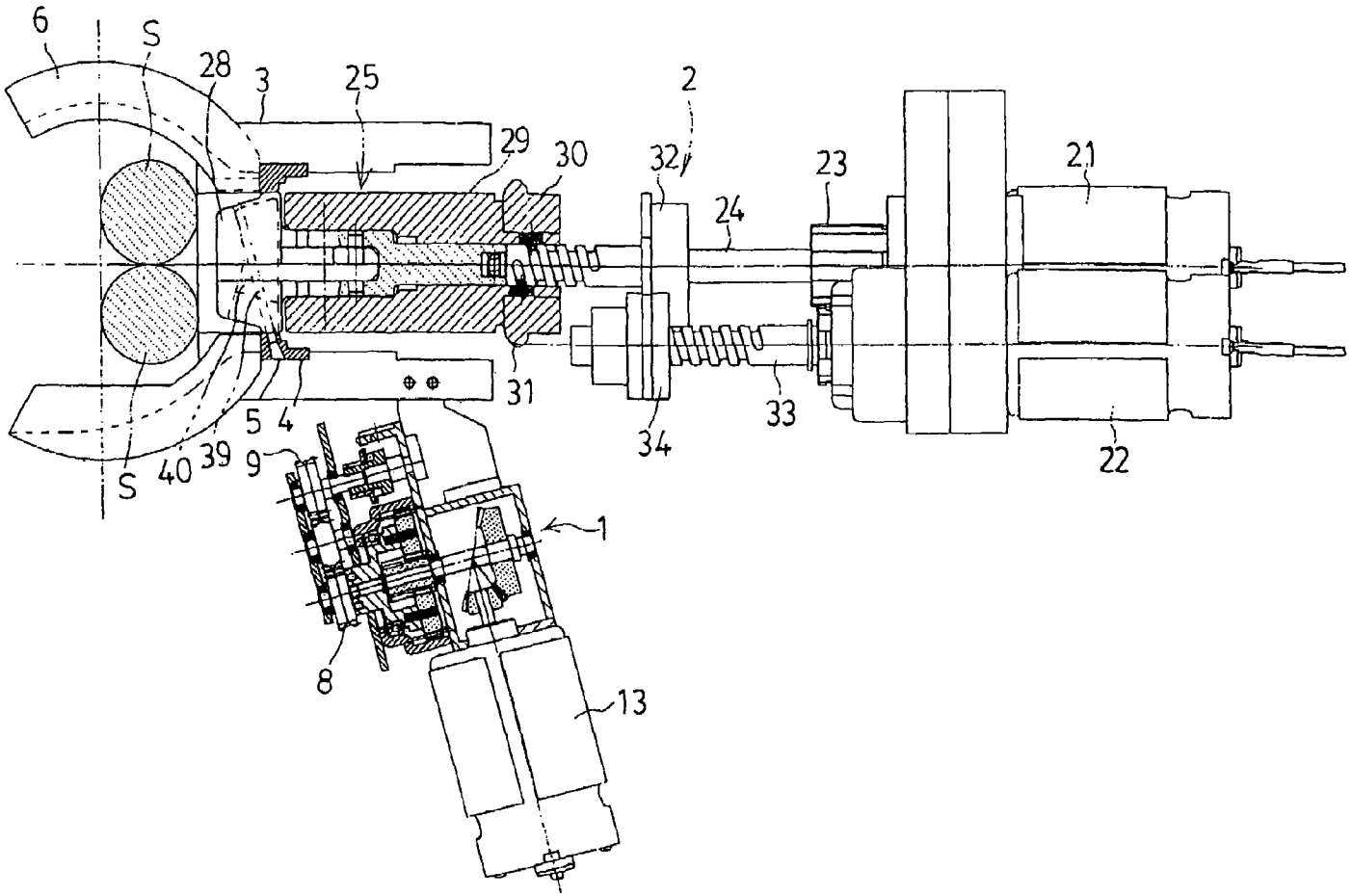
FIG. 1 is a side sectional view showing a mechanism portion of a reinforcing bar binding machine according to the invention.

Further, in notations in the drawings, numeral 1 designates a binding wire feeding mechanism, numeral 2 designates a binding wire twisting mechanism, numeral 6 designates a nose, numeral 7 designates a base plate, numerals 8, 9 designate driving gears having V-grooves, numerals 10, 11 designate driven gears having V-grooves, numeral 12 designates a middle gear, numeral 13 designates a feeding motor, numeral 14 designates a reduction gear, numeral 15 designates a gear holder, numeral 16 designates a long hole, numeral 17 designates a pin, numeral 18 designates a lever, numeral 19 designates a spring receiving seat, numeral 20 designates a compression coil spring, numeral 21 designates a twisting motor, numeral 22 designates a sliding motor, numeral 24 designates a ball screw shaft, numeral 25 designates a binding wire clamping apparatus, numeral 26 designates a center clamp plate, numeral 27 designates a right front plate, numeral 28 designates a left front plate, numeral 29 designates a sleeve, numeral 51 designates a control apparatus, numeral 52 designates a regular and reverse rotation driving circuit, numeral 53 designates a revolution number detecting sensor, and numeral 59 designates a current detecting circuit.

BEST MODE FOR CARRYING OUT THE INVENTION

Figure 2:
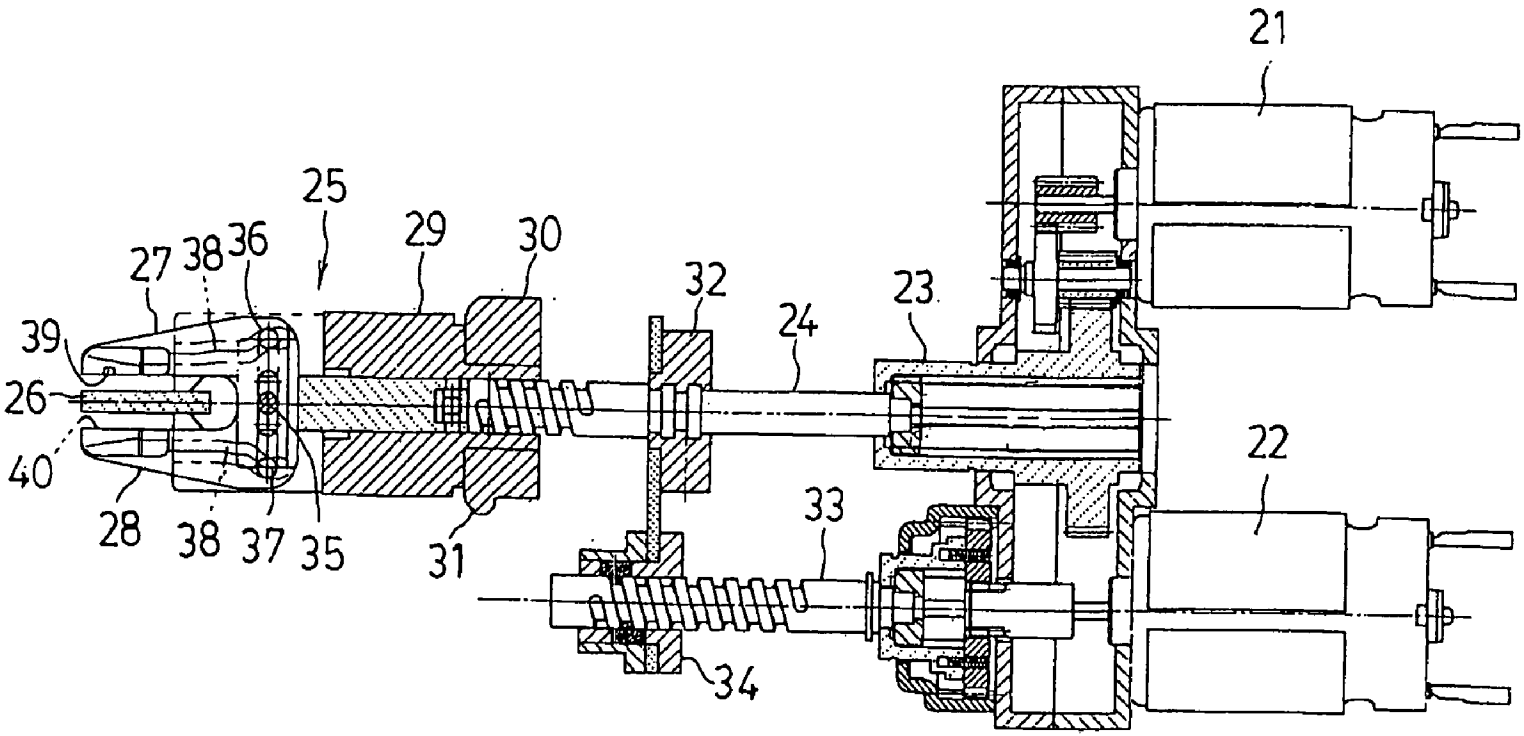
FIG. 2 is a plane sectional view showing the mechanism portion of the reinforcing bar binding machine according to the invention.
Figure 3:
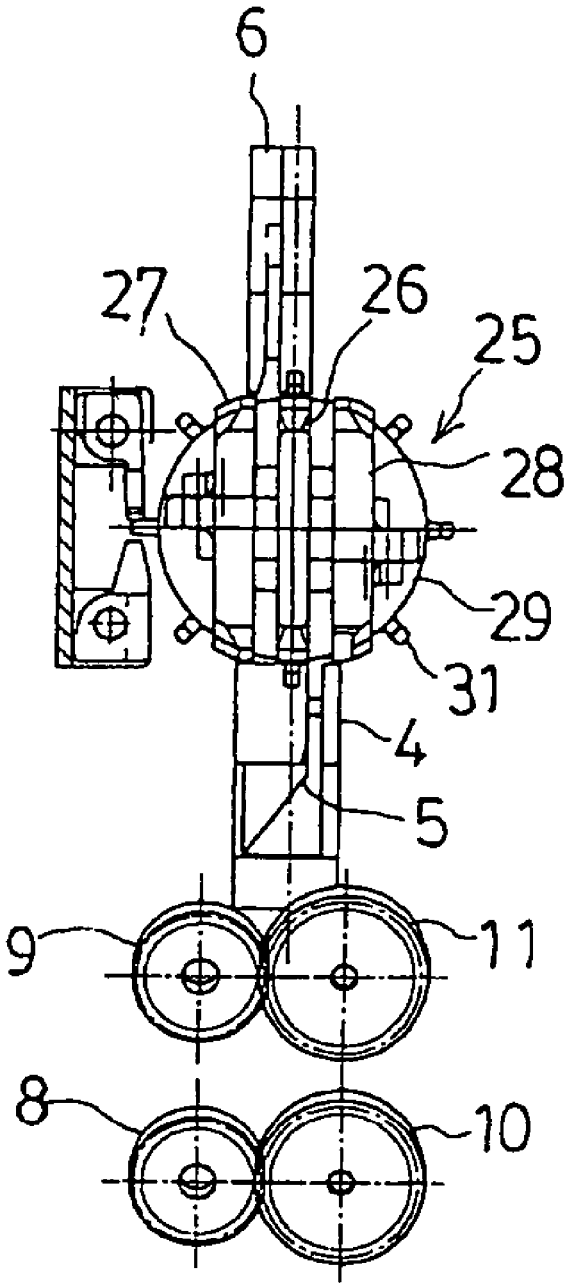
FIG. 3 is a front view showing the mechanism portion of the reinforcing bar binding machine according to the invention.

A detailed description will be given of an embodiment of the invention in reference to the drawings as follows. FIG. 1 through FIG. 3 show the binding wire feeding mechanism 1 and the binding wire twisting mechanism 2 of the reinforcing bar binding machine, which are included in a casing (not illustrated) having a grip similar to a hand-held tool of a nailing machine or the like. A wire wound around a wire reel (not illustrated) is supplied to the nose 6 bent in a shape of a circular ark through a binding wire guide hole 5 of a cutter block 4 provided at the nose portion 3 by the binding wire feeding mechanism 1.

Figure 4A:
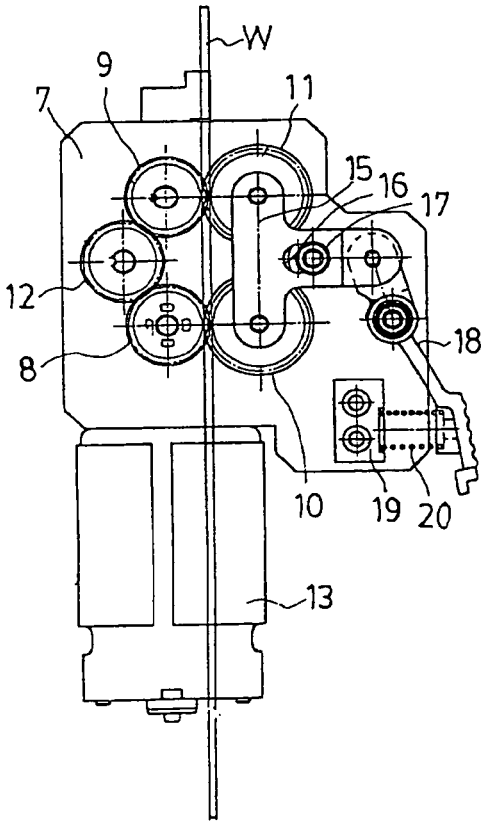
FIGS. 4(*a*) and 4(*b*) show a binding wire feeding mechanism of the reinforcing bar binding machine, FIG. 4(*a*) is a front view and FIG. 4(*b*) is a side sectional view.
Figure 4B:
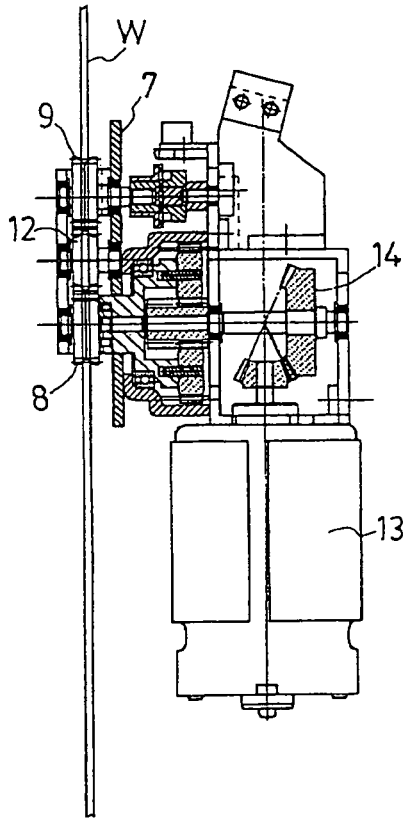

FIGS. 4(*a*) through 4(*b*) show the binding wire feeding mechanism 1, the driving gears 8, 9 having V-grooves are arranged above the base plate 7 along a direction of advancing a wire W (binding wire) and two pieces of front and rear driving gears 8, 9 having V-grooves are respectively brought in mesh with the driven gears 10, 11 having V-grooves. The two pieces of driving gears 8, 9 having V-grooves are brought in mesh with the middle gear 12, power is transmitted from the feeding motor (DC motor) 13 via the reduction gear 14 and the middle gear 12 and the two pieces of driving gears 8, 9 having V-grooves are synchronizingly rotated.

The two front and rear pieces of the driven gears 10, 11 having V-grooves are attached to the gear holder 15 in a shape of a bell crank. A middle portion of the gear holder 15 is formed with the long hole 16 in a direction orthogonal to a direction of feeding the wire and the gear holder 15 is held pivotably in the front and rear direction and in a left and rear direction by engaging the pin 17 provided at the base plate 7 with the long hole 16. The base plate 7 is attached with the lever 18 and a front end portion of the lever 18 and a rear end portion (right end portion in the drawing) of the gear holder 15 are coupled by a pin. The compression coil spring 20 is interposed between a rear end portion of the lever 18 and the spring receiving seat 19 provided above the base plate 7, the front end potion of the lever 18 and the gear holder 15 are urged in a direction of the driving gears 8, 9 having V-grooves opposed to each other and the two pieces of driven gears 10, 11 having V-grooves are respectively brought into elastic contact with the driving gears 8, 9 having V-grooves.

In using the reinforcing bar binding machine, the lever 18 is pivoted by pressing the rear end portion of the lever 18 by the finger and the gear holder 15 is moved rearward to thereby bring about a state of separating two pieces of the driven gears 10, 11 having V-grooves from the driving gears 8, 9 having V-grooves and a front end portion of the wire W extracted from the wire reel is made to pass between the driving gears 8, 9 having V-grooves and the driven gears 10, 11 having V-grooves. Further, when the lever 18 is released from being pressed, the wire W is pinched between the V-grooves of the driving gears 8, 9 having the V-grooves and the driven gears 10, 11 having the V-grooves and the driving gears 8, 9 having the V-grooves and the driven gears 10, 11 having the V-grooves are brought in mesh with each other to prepare for use.

Although when linearity of the wire is poor, in drawing the wire by the driving gear 8 having the V-groove and the driven gear 10 having the V-groove from an upstream side (lower side in the drawing), the driven gear 10 having the V-groove may be separated from the driving gear 8 having the V-groove by being pressed in a lateral direction, at this occasion, the gear holder 15 is pivoted by constituting a fulcrum by the pin 17 and the driven gear 11 having the V-groove on the downstream side stays to be brought in mesh with the driving gear 9 having the V-groove to thereby continue feeding the wire W. Further, even when the driving gears 9 having the V-groove and the driven gear 11 having the V-groove on the downstream side are deviated from being brought in mesh with each other by local irregularities of the wire passing the driving gear 8 having the V-groove and the driven gears 10 having the V-groove on the upstream side, the driving gear 8 having the V-groove and the driven gear 10 having the V-groove on the upstream side are brought in mesh with each other and the wire is not stopped from being fed.

Next, the binding wire twisting mechanism 2 will be explained. As shown by FIG. 1 and FIG. 2, the binding wire twisting mechanism 2 includes two motors of the twisting motor 21 and the sliding motor 22, and the twisting motor 21 drives a final gear 23 via a reduction gear train. The ball screw shaft 24 is fit to a center hole of the final gear 23 by a spline. A male screw is formed at a front end portion of the ball screw shaft 24 and a front end thereof is rotatably coupled with a shaft portion of the center clamp plate 26 constituting a portion of the binding wire clamping apparatus 25. The binding wire clamping apparatus 25 comprises the center clamp plate 26, the clamp plates 27, 28 arranged on the left and on the right of the center clamp plate 26, the sleeve 29 covering three sheets of the clamp plates 26, 27, 28 and a ball hold ring 30 fit to a rear end of the sleeve 29 and a ball (not illustrated) fit to a hole of the sleeve 29 is brought in mesh with the male screw of the ball screw shaft 24.

When the twisting motor 21 is rotated in a regular direction, the sleeve 29 is moved rearward by rotating the ball screw shaft 24. An outer periphery of the ball hold ring 30 is radially arranged with a rotation stopping fin 31 and at a frontmost position constituting an initial position, a claw (not illustrated) for stopping rotation provided at the casing is engaged with the rotation stopping fin 31 of the ball hold ring 30 and the binding wire clamping apparatus 25 is brought into an unrotatable state.

A middle portion of the ball screw shaft 24 is attached with a shifter disk 32 rotatable relative to the ball screw shaft 24. The shifter disk 32 is connected to a ball hold ring 34 screwed to a ball screw shaft 33 of the sliding motor 22 and the ball screw shaft 24 and the binding wire clamping apparatus 25 of the binding wire twisting mechanism 2 are moved in the front and rear direction in accordance with a direction of rotating the sliding motor 22.

The left and right clamp plates 27, 28 can be slid to the left and to the right in parallel with each other along a guide pin 35 provided at the center clamp plate 26 and guide pins 36, 37 provided at the clamp plates 27, 28 are engaged with groove cams 38 formed at inner peripheral faces of the sleeve 29. The groove cams 38 are reformed by shapes of approaching the left and the right clamp plates 27, 28 to each other when the sleeve 29 is moved rearward and finally, the left and right clamp plates 27, 28 pinch the center clamp plate 26.

Figures 5A, 5B, 5C:
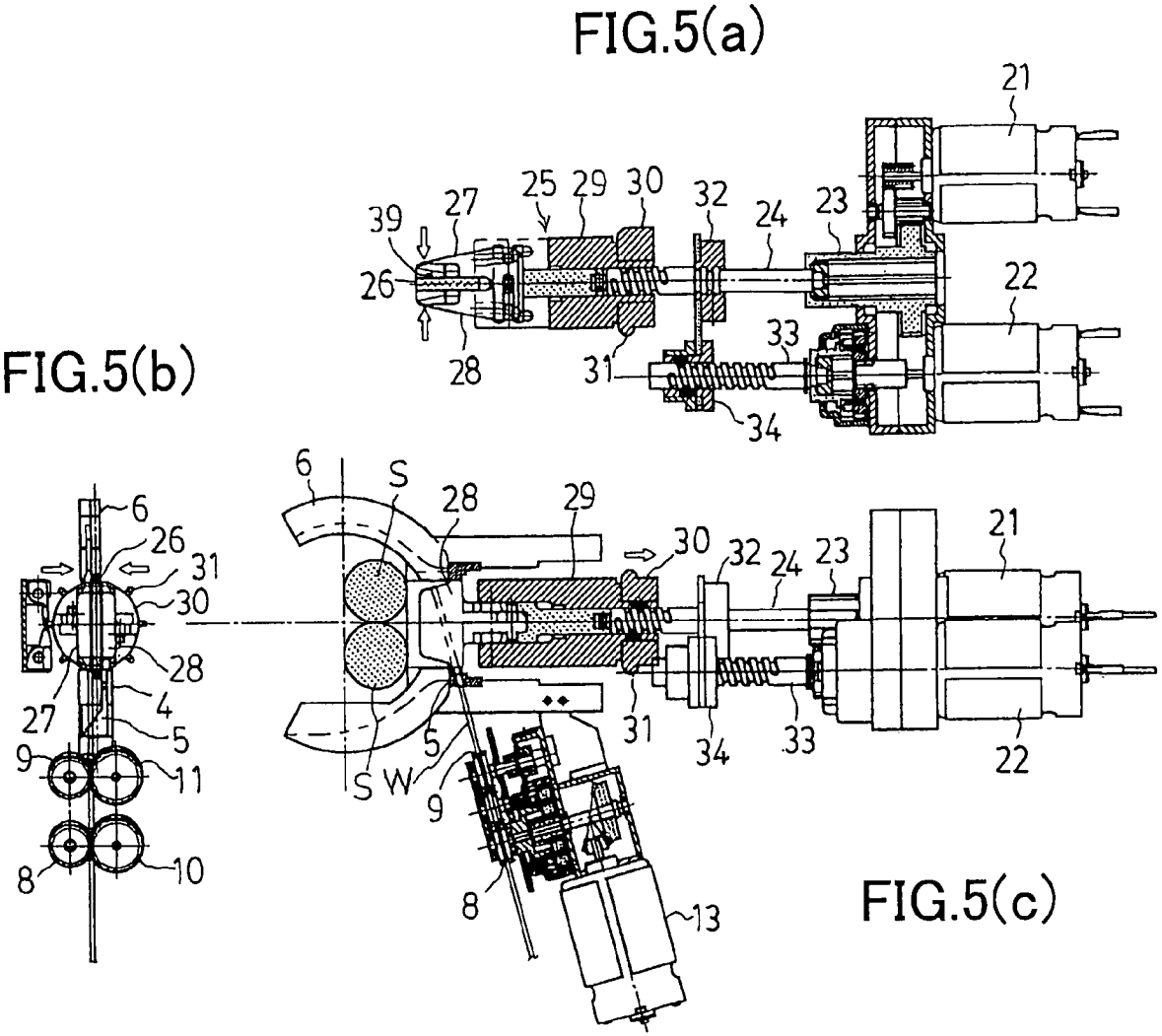
FIGS. 5(*a*) 5(*b*) and 5(*c*) show a step of forming a binding wire path of a reinforcing bar binding machine, FIG. 5(*a*) is a plane sectional view, FIG. 5(*b*) is a front view and FIG. 5(*c*) is a side sectional view.

Next, operation of the reinforcing bar binding machine will be explained. FIG. 1 through FIG. 3 show an initial state, when a trigger is pulled from the state, the twisting motor 21 is rotated in the regular direction by a predetermined number of times and as shown by FIGS. 5(*a*) through 5(*c*), the sleeve 29 is moved rearward and the left and right clamp plates 27, 28 are lightly closed. A binding wire guide groove 39 for constituting a path for feeding out the wire is formed at the clamp plate 27 on a right side (upper side in FIG. 5(*a*)) in view from an operator. The clamp plate 28 on a left side is formed with a recess 40 in a shape of a channel reaching a lower end from an upper portion of an inner side face thereof and in a successive step of feeding the wire, the wire is introduced from a lower side of the clamp plate 28 into the recess 40.

Figures 6A, 6B, 6C:
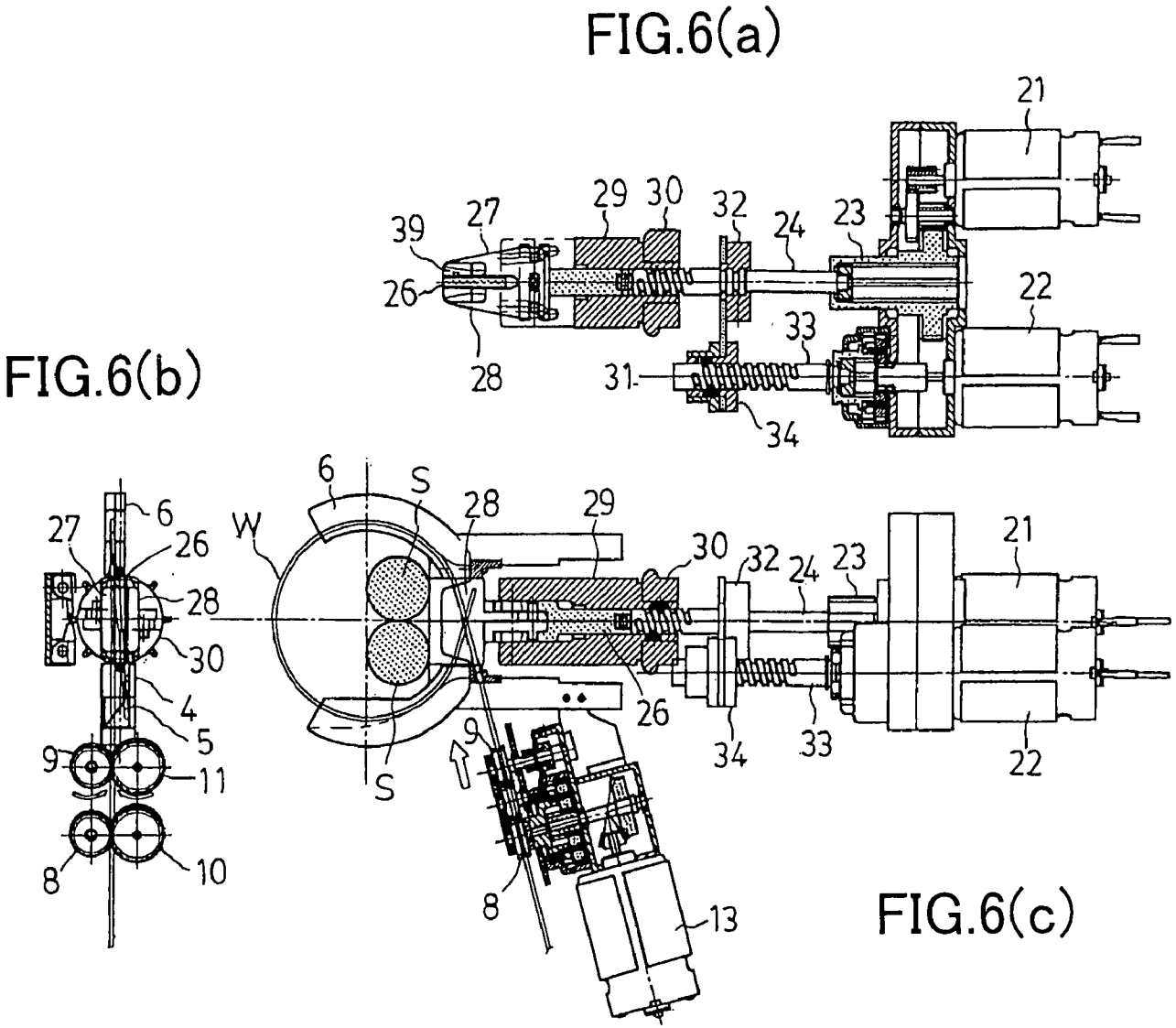
FIGS. 6(*a*), 6(*b*) and 6(*c*) show a step of feeding a binding wire, FIG. 6(*a*) is a plane sectional view, FIG. 6(*b*) is a front view and FIG. 6(*c*) is a side sectional view.

Successively, as shown by FIG. 6(*a*) through FIG. 6(*c*), the feeding motor 13 is started, the wire W reeled out into the nose 6 via the guide groove 39 of the clamp plate 27 on the right side by rotating the two front and rear pairs of driving gears 8, 9 having the V-grooves and driven gears 10, 11 having the V-grooves, is bent in a shape of a loop along a shape of a guide groove at an inner periphery of the nose 6 and the front end advances from an opening of a lower face of the clamp plate 28 on the left side into the recess 40 and impinges on a ceiling portion of the recess 40 to stop. An amount of feeding the wire W is controlled by the control apparatus. Further, notation S designates the reinforcing bar.

Figures 7A, 7B, 7C:
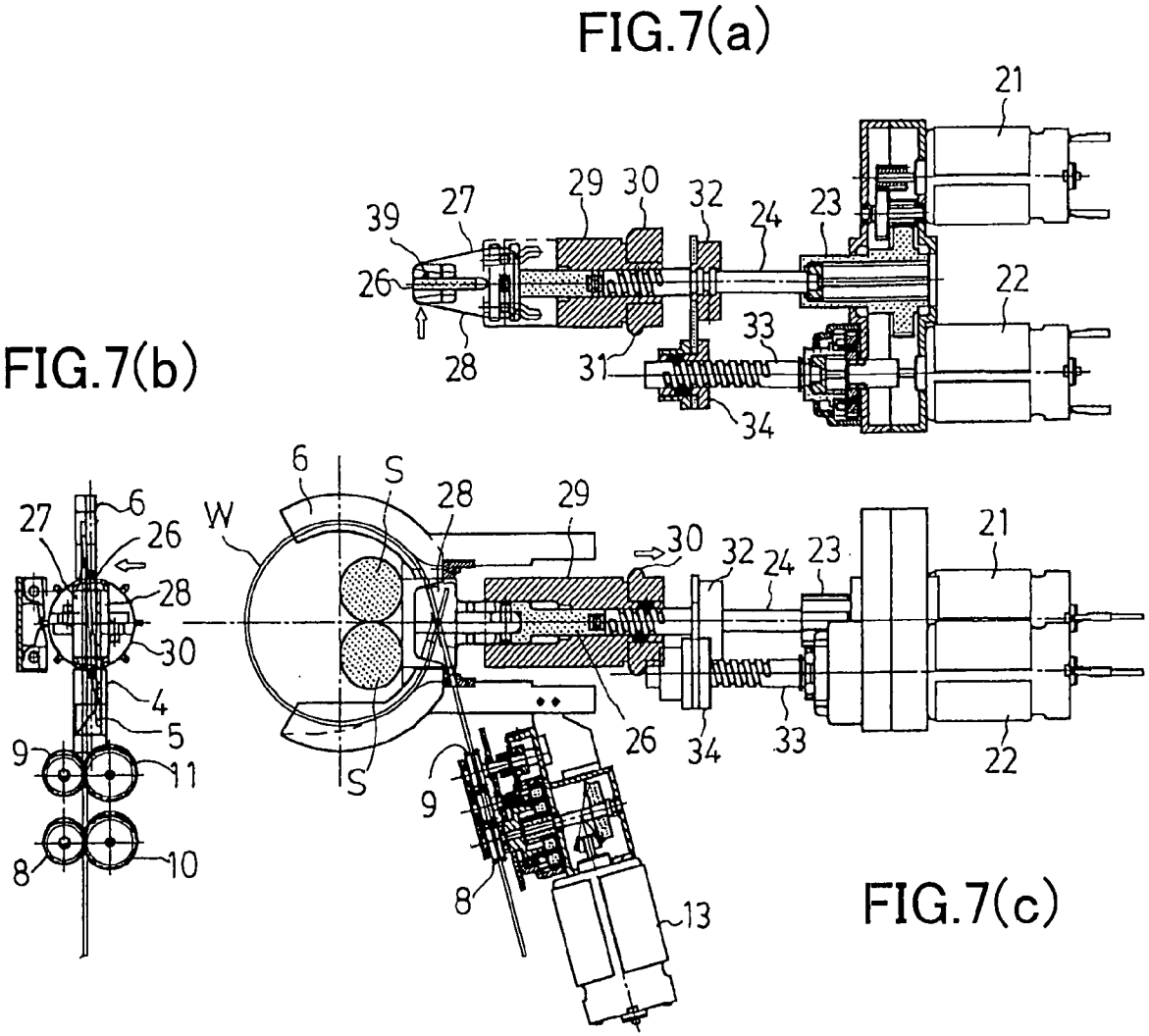
FIGS. 7(*a*), 7(*b*) and 7(*c*) show a step of grabbing the binding wire, FIG. 7(*a*) is a plane sectional view, FIG. 7(*b*) is a front view and FIG. 7(*c*) is a side sectional view.
Figures 8A, 8B, 8C:
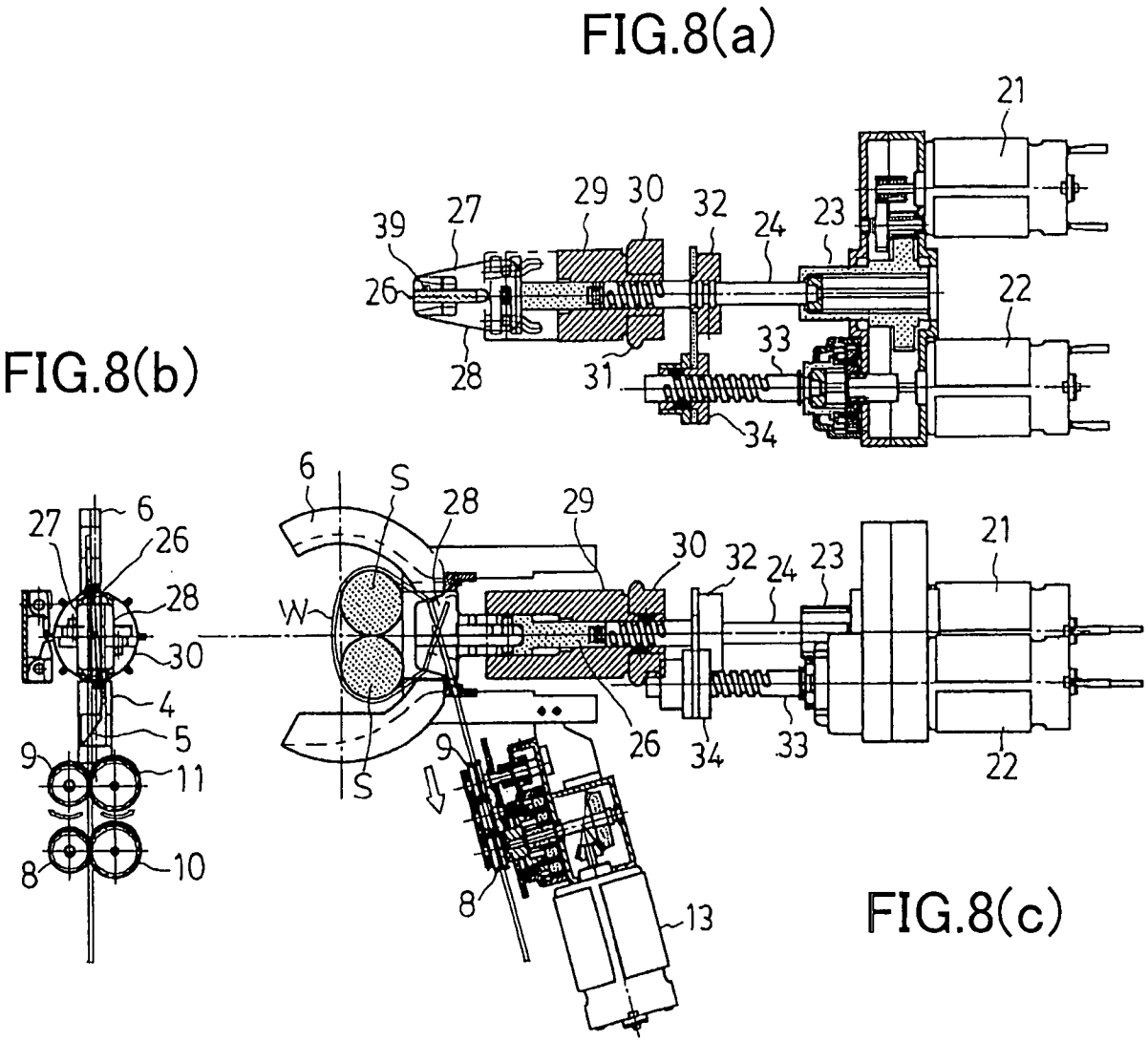
FIGS. 8(*a*), 8(*b*) and 8(*c*) show a step of pulling back the binding wire of a binding wire twisting mechanism, FIG. 8(*a*) is a plane sectional view, FIG. 8(*b*) is a front view and FIG. 8(*c*) is a side sectional view.

The twisting motor 21 is started after stopping the feeding motor 13, as shown by FIG. 7(*a*) through FIG. 7(*c*), the sleeve 29 is moved further rearward and the clamp plate 28 on the left side is brought into press contact with the center clamp plate 26 to pinch the front end portion of the wire W. Successively as shown by FIG. 8(*a*) through FIG. 8(*c*), the feeding motor 13 is driven to rotate reversely to pull back the wire W and a length of the loop is adjusted in accordance with a diameter of the reinforcing bar.

Figure 16:
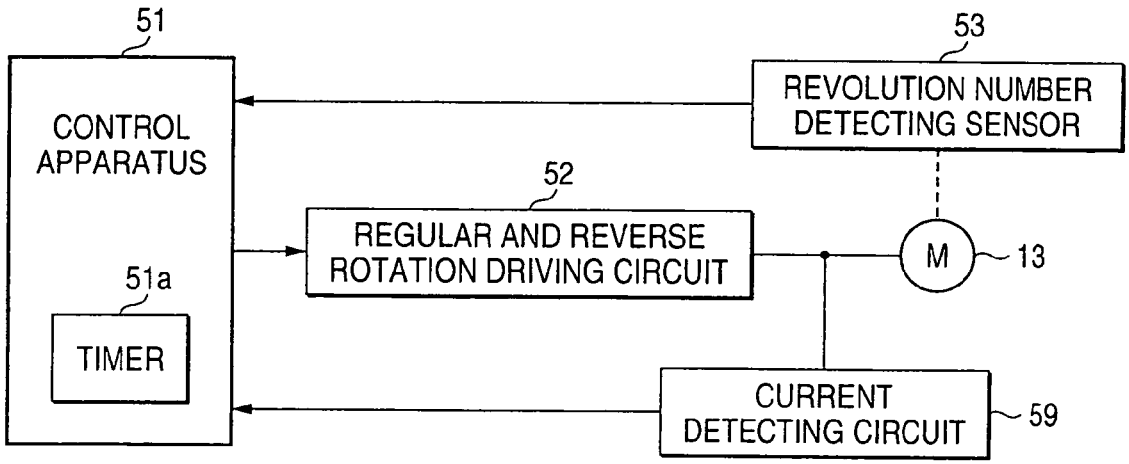
FIG. 16 is a block diagram of an electric circuit of a binding wire feeding mechanism.

FIG. 16 is a block diagram of an electric circuit of the binding wire feeding mechanism 1 and the control apparatus 51 drives the feeding motor 13 via the regular and reverse rotation driving circuit 52. A rotation pulse of the feeding motor 13 outputted by the revolution number detecting sensor 53 and a value of a current for driving the motor outputted by the current detecting circuit 59 are inputted to the control apparatus 51 and the control apparatus 51 controls the feeding motor 13 based on time, the motor revolution number and the motor driving current value.

Figure 17:
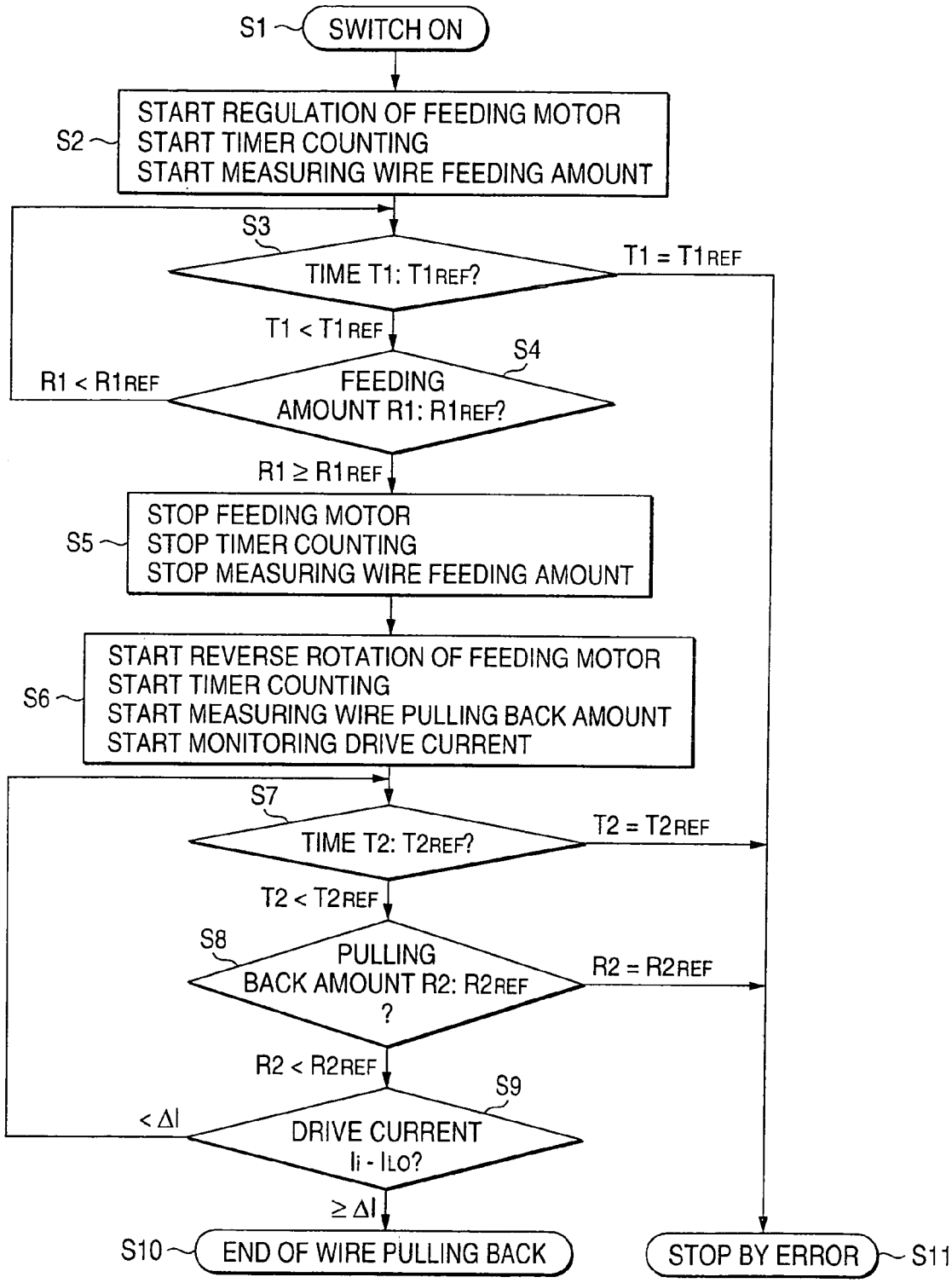
FIG. 17 is a flowchart of controlling the binding wire feeding mechanism.

FIG. 17 shows control steps from starting the binding wire feeding mechanism 1 to a step of pulling back the wire and when the feeding motor 13 is started by making a trigger switch ON (S1), at the same time, a timer 51*a* of the control apparatus 51 starts measuring a time of driving the feeding motor 13 to measure an amount of feeding the wire (calculated from the revolution number of the feeding motor 13)(S2).

When a measured time T1 is less than a wire feeding reference time $T1_{REF}$ and a wire feeding amount R1 is less than a reference feeding amount $R1_{REF}$, in a loop of S3 and S4, the feeding motor 13 is continued to drive to rotate regularly, when the wire feeding amount R1 reaches the reference feeding amount $R1_{REF}$, the feeding motor 13 is stopped, counting of time is stopped and measurement of the wire feeding amount is stopped to reset (S5). When a failure in feeding is brought about by some cause and the measured time T1 reaches the wire feeding reference time $T1_{REF}$ before the wire feeding amount R1 reaches the reference feeding amount $R1_{REF}$, the operation proceeds from S3 to S11 to stop the feeding motor 13.

When the wire is normally fed, after stopping the feeding motor, the feeding motor is driven to rotate reversely to proceeds to a step of pulling back the wire. At this occasion, measurement of the driving time and an amount of pulling back the wire is started, drive current is measured at each unit time to store and a newest current value $I_i$ and a lowest value $I_{LO}$ of the current value are compared to monitor a change in the current (S6). When a measured time T2 is less than a reference time $T2_{REF}$ of pulling back the wire (incidentally, $T2_{REF}<T1_{REF}$) and a pullback amount R2 is less than a reference pullback amount $R2_{REF}$ (incidentally, $R2_{REF}<R1_{REF}$) and an increase by a predetermined amount $\Delta I$ is not observed in the drive current $I_i$, the feeding motor 13 is continued to drive to rotate reversely by a loop of S7→S8→S9.

Figure 18:
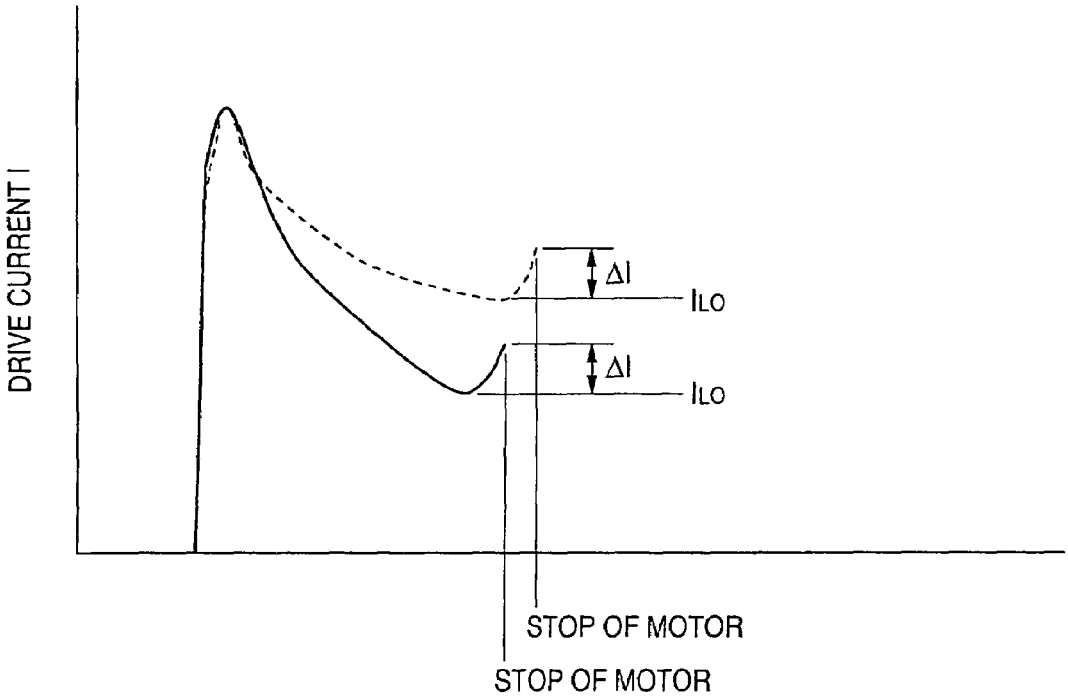
FIG. 18 is a graph showing a change in a current of driving a feeding motor.

FIG. 18 shows a change in the current of driving the feeding motor 13, a peak current is made to flow in starting to rotate reversely, the drive current is reduced in accordance with an increase in the revolution number thereafter and at this occasion, the lowest current value $I_{LO}$ is successively updated. Further, when the wire is wound around the reinforcing bar by pulling back the wire, a rotational load is increased and the change in the drive current I is changed from reduction to increase. Further, a dotted line indicates a change in the drive current when diameter of the wire is bold and when the wire is bold, a resistance of pulling back the wire is large and therefore, the lowest current value $I_{LO}$ at a point of changing from reduction to increase is increased. Further, when the newest measured current value $I_i$ is increased from the lowest current value $I_{LO}$ by the predetermined amount $\Delta I$, the operation proceeds from S9 to S10, the feeding motor 13 is stopped to thereby finish the step of pulling back the wire (S10) to proceed to a successive step of twisting the wire.

Further, in the step of feeding out the wire before the step of pulling back the wire, when a failure in a feeding the wire is brought about or the wire impinges on other hazard and the front end of the wire is not introduced into between the clamp plate 28 and the center clamp plate 26 and the wire cannot be clamped, the pulling back resistance is not increased and also the drive current I is not increased and when the pulling back amount R2 reaches the reference pulling back amount $R2_{REF}$, the operation proceeds such that S8→S11 and stops the feeding motor 13. Further, also when the measured time T2 reaches the wire pulling back reference time $T2_{REF}$, the operation proceeds such that S7→S11 and stops the feeding motor 13. Here, $R2_{REF}<R1_{REF}$ and $T2_{REF}<T1_{REF}$ and therefore, there is not brought about a situation in which the feeding motor is stopped before the front end of the pulled-back wire passes the driving gears 8, 9 having the V-grooves and the driven gears 10, 11 having the V-grooves of the binding wire feeding mechanism 1 and the wire must be reset to between the driving gears 8, 9 having the V-grooves and the driven gears 10, 11 having the V-grooves.

Further, although according to the embodiment, two sets of the feeding mechanisms combined with the driving gears having the V-grooves and the driven gears having the V-grooves are provided, one set thereof will do.

Figures 9A, 9B, 9C:
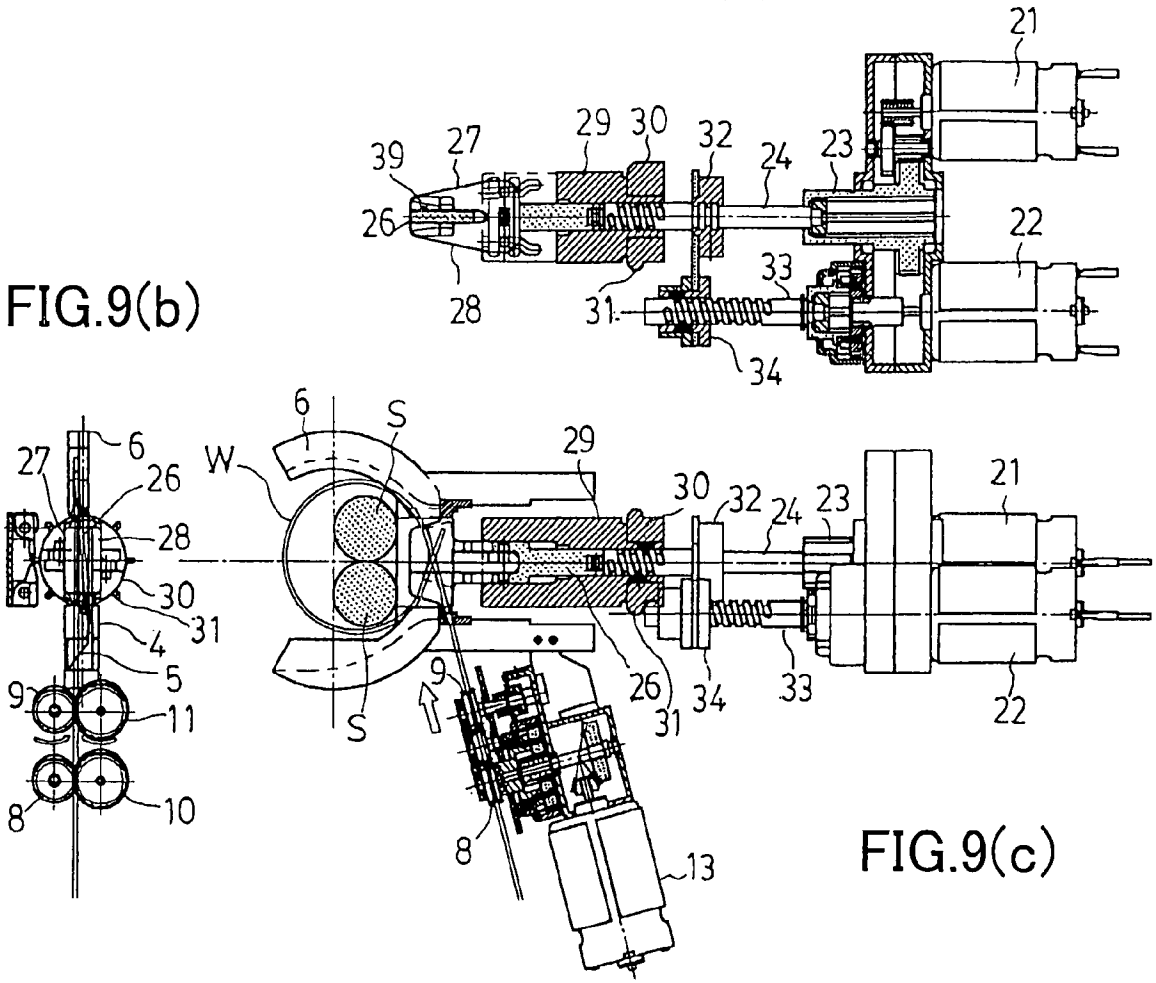
FIGS. 9(*a*), 9(*b*) and 9(*c*) show a step of refeeding the binding wire, FIG. 9(*a*) is a plane sectional view, FIG. 9(*b*) is a front view and FIG. 9(*c*) is a side sectional view.

Successive to the step of pulling back the wire shown in FIG. 8(*a*) through FIG. 8(*c*), as shown by FIG. 9(*a*) through FIG. 9(*c*), the wire W is fed out by a predetermined length by driving to rotate the feeding motor 13 regularly. The step is for making an amount of projecting of a knot portion uniform by constituting a margin of twisting the wire W by a constant length regardless of a boldness of the reinforcing bar.

Figures 10A, 10B, 10C:
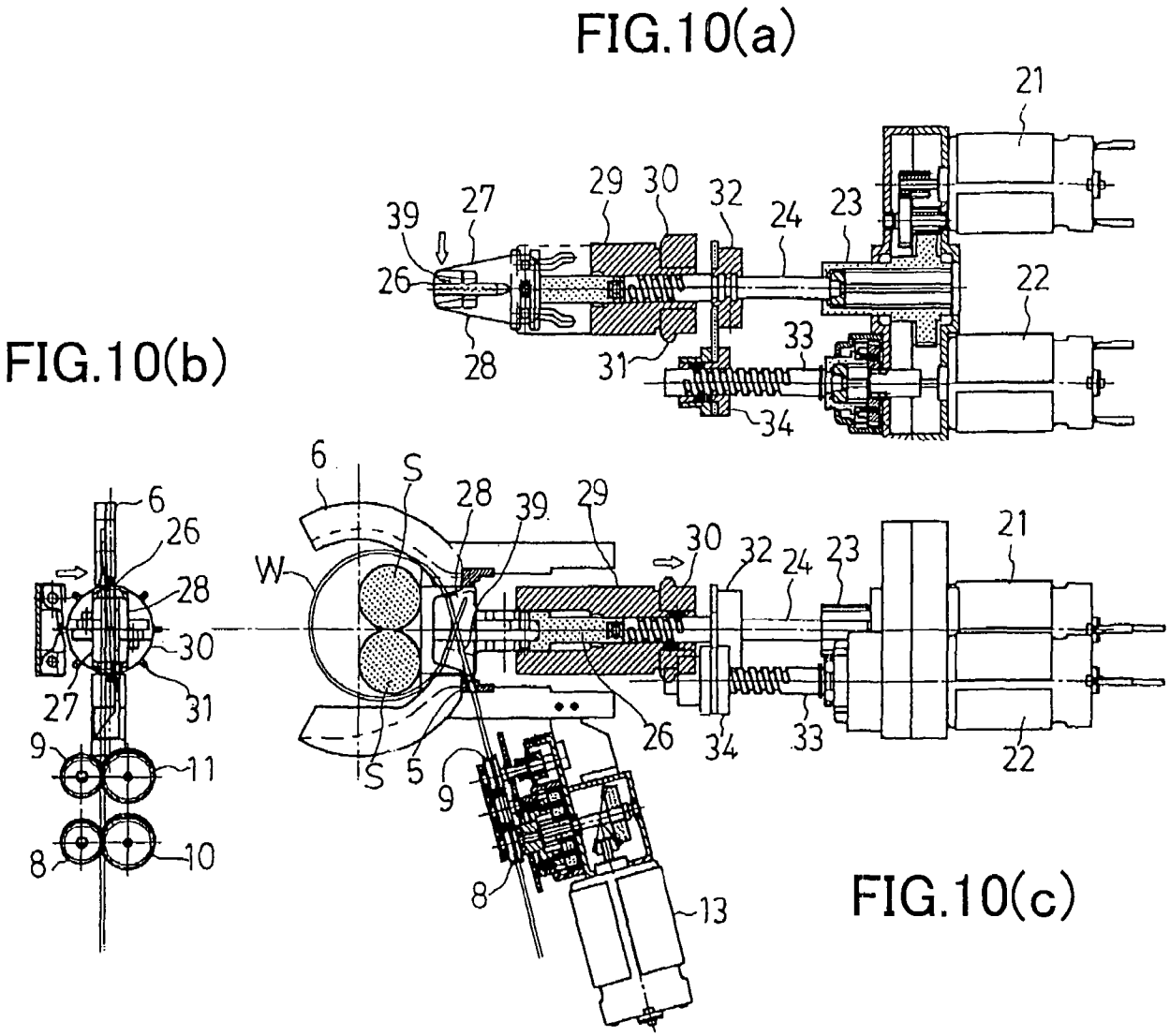
FIGS. 10(*a*), 10(*b*) and 10(*c*) show a step of grabbing the binding wire, FIG. 10(*a*) is a plane sectional view, FIG. 10(*b*) is a front view and FIG. 10(*c*) is a side sectional view.
Figures 11A, 11B, 11C:
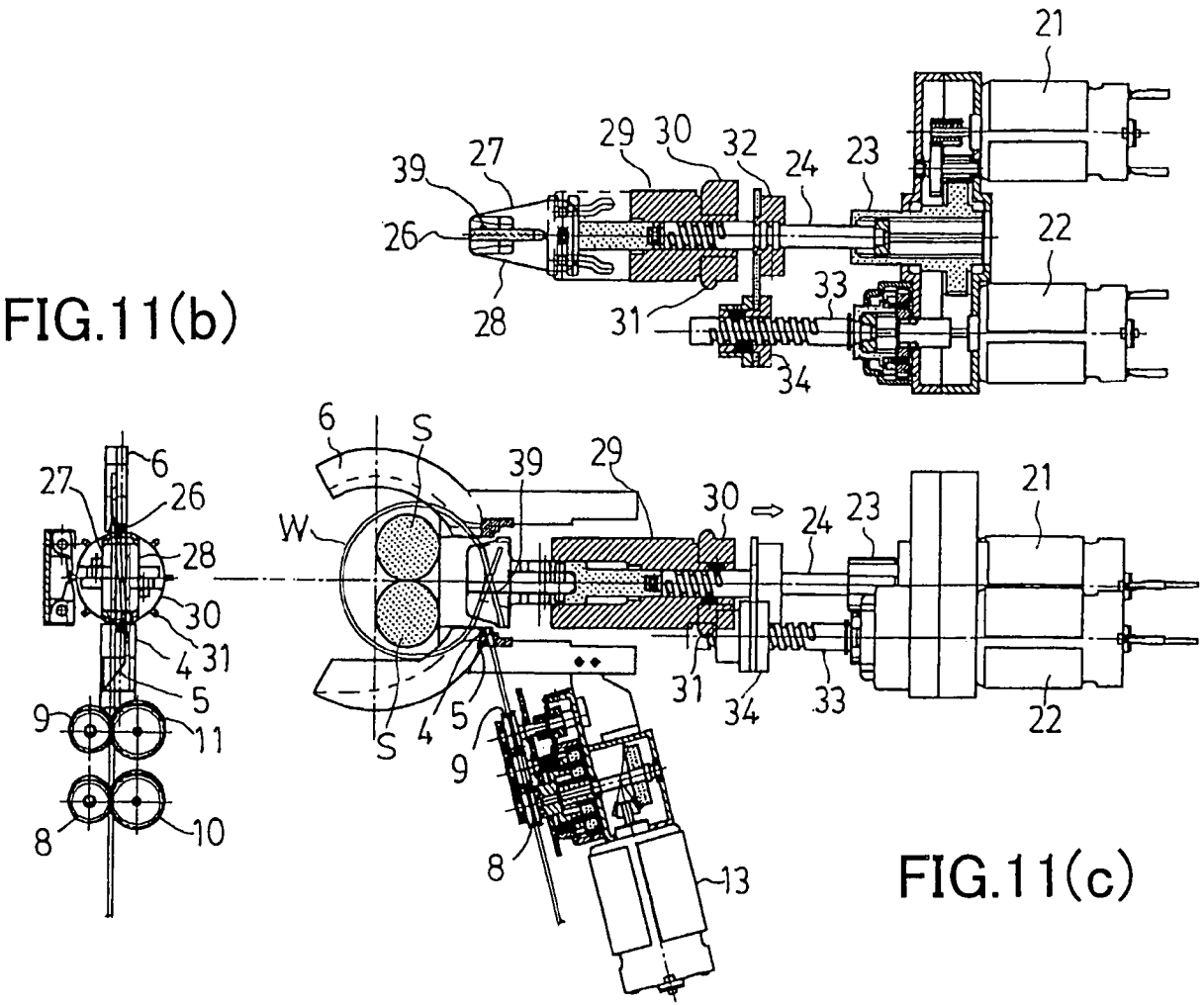
FIGS. 11(*a*), 11(*b*) and 11(*c*) show a step of cutting the binding wire, FIG. 11(*a*) is a plane sectional view, FIG. 11(*b*) is a front view and FIG. 11(*c*) is a side sectional view.

Further, as shown by FIG. 10(*a*) through FIG. 10(*c*), the sleeve 29 is moved further rearward, the wire W is solidly pinched by the left and right clamp plates 27, 28 and the center clamp plate 26, as shown by FIG. 11(*a*) through FIG. 11(*c*), the sliding motor 22 is driven to rotate regularly and the ball screw shaft 24 and the binding wire clamping apparatus 25 are moved rearward. By moving the binding wire clamping apparatus 25 in parallel with the binding wire guide hole 5 of the cutter block 4, the wire W is sheared at a position of faces of the guide hole 39 of the left clamp plate 27 and the binding wire guide hole 5 sliding relative to each other.

Figures 12A, 12B, 12C:
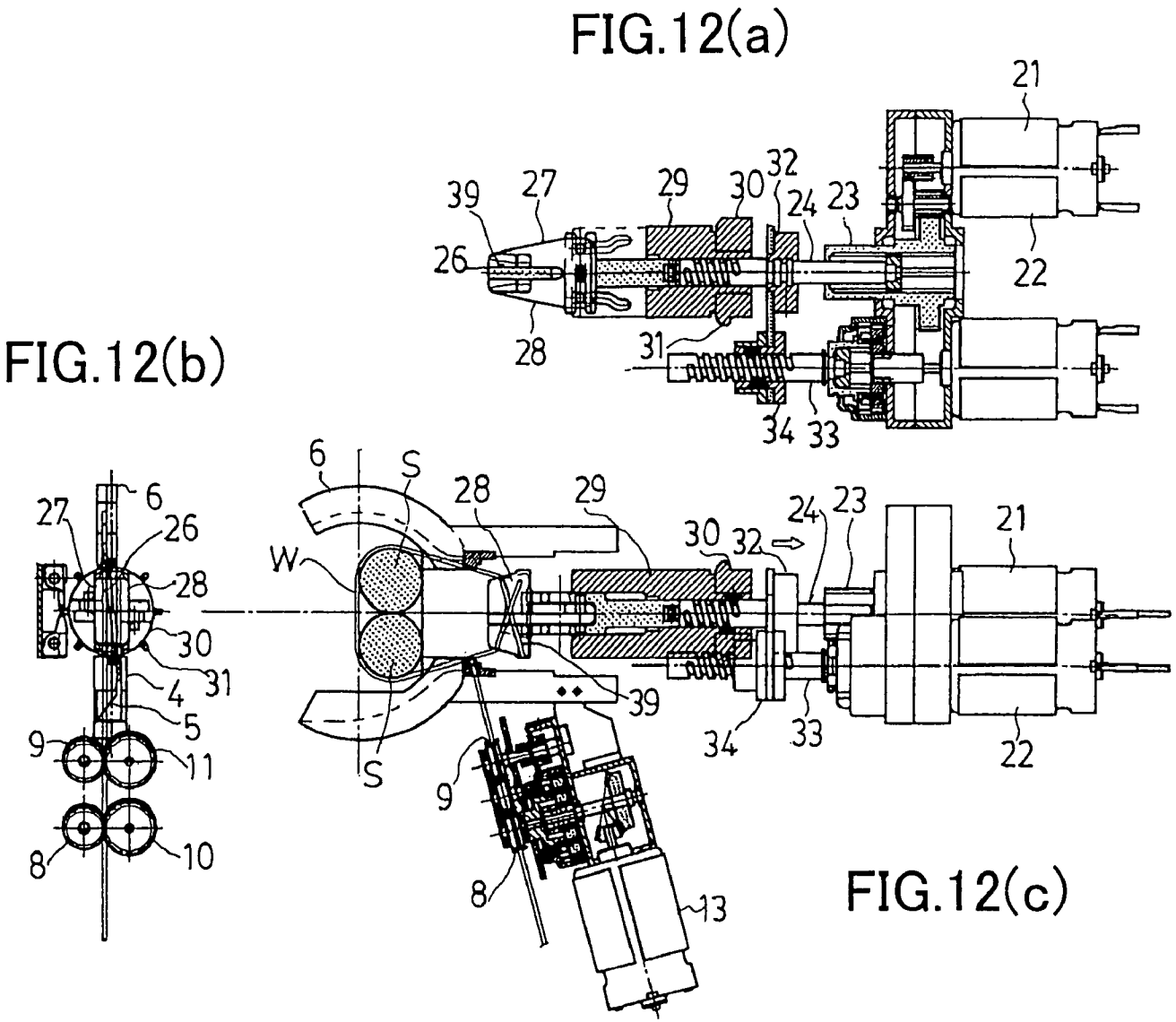
FIGS. 12(*a*), 12(*b*) and 12(*c*) show a step of tightening the binding wire, FIG. 12(*a*) is a plane sectional view, FIG. 12(*b*) is a front view and FIG. 12(*c*) is a side sectional view.

Further, as shown by FIG. 12(*a*) through 12(*c*), when the binding wire clamping apparatus 25 is moved further rearward to exert a tension to the wire W and when the drive current reaches a predetermined upper limit value by increasing the load of driving the sliding motor 22, the sliding motor 22 is stopped. Further, in the step of tightening the wire, the binding wire clamping apparatus 25 may be moved rearward after intersecting the wire W by previously rotating the binding wire clamping apparatus 25 by a half rotation.

Figure 13B:
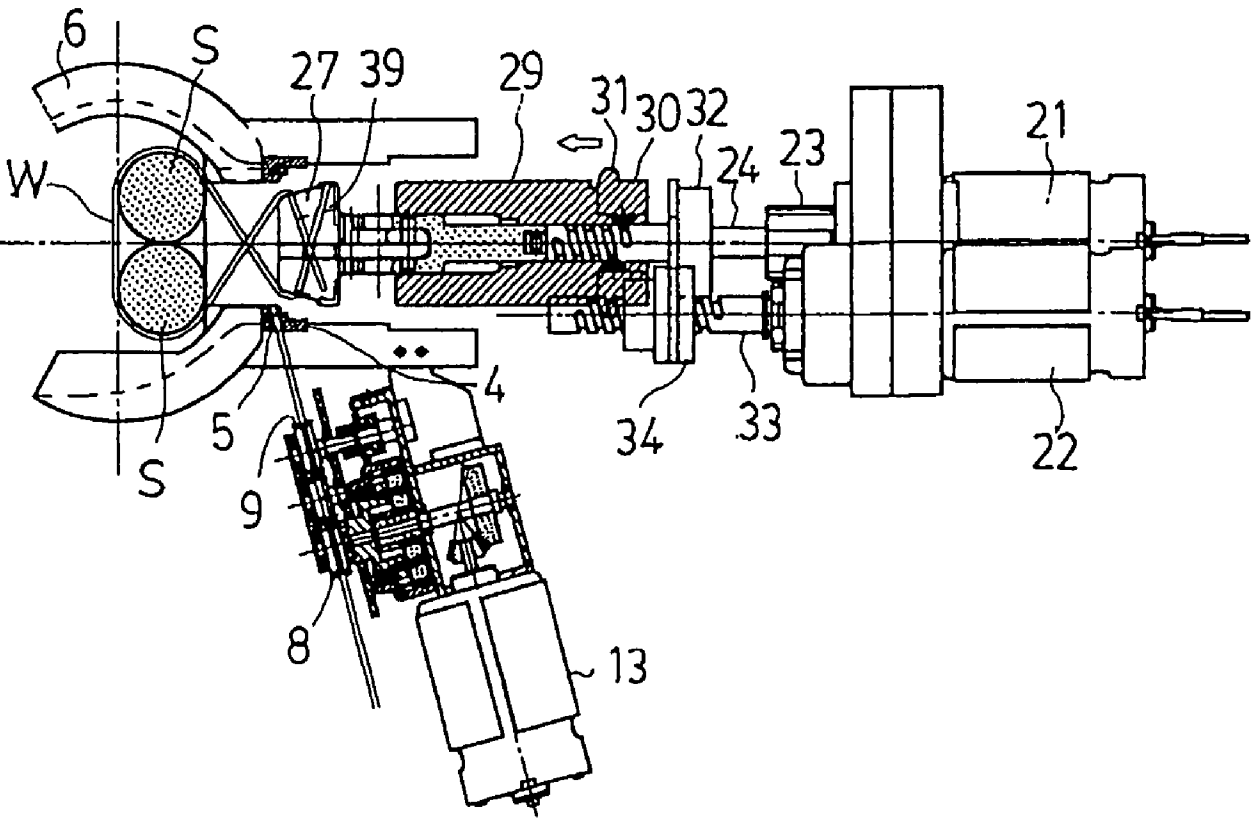
FIGS. 13(*a*) and 13(*b*) show a twisting step, FIG. 13(*a*) is a front view and FIG. 13(*b*) is a side sectional view.
Figure 13A:
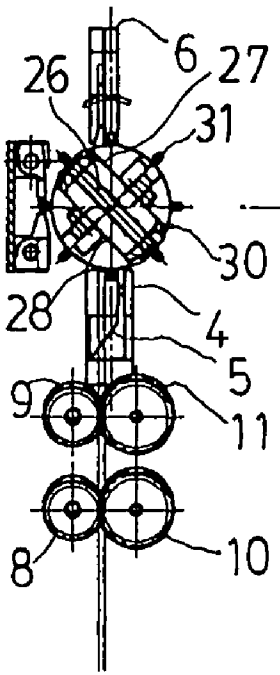

Next, the twisting motor 21 is driven to rotate regularly, the rotation stopping fin 31 of the ball hold ring 30 moved rearward from the initial position is detached from the rotation stopping claw of the casing and therefore, as shown by FIG. 13(*a*) through 13(*c*), the binding wire clamping apparatus 25 is rotated. At the same time, the ball screw shaft 24 and the binding wire clamping apparatus 25 are moved forward by driving to rotate the sliding motor 22 reversely and the binding wire clamping apparatus 25 twists the wire W while approaching the reinforcing bar S.

Figures 14A, 14B, 14C:
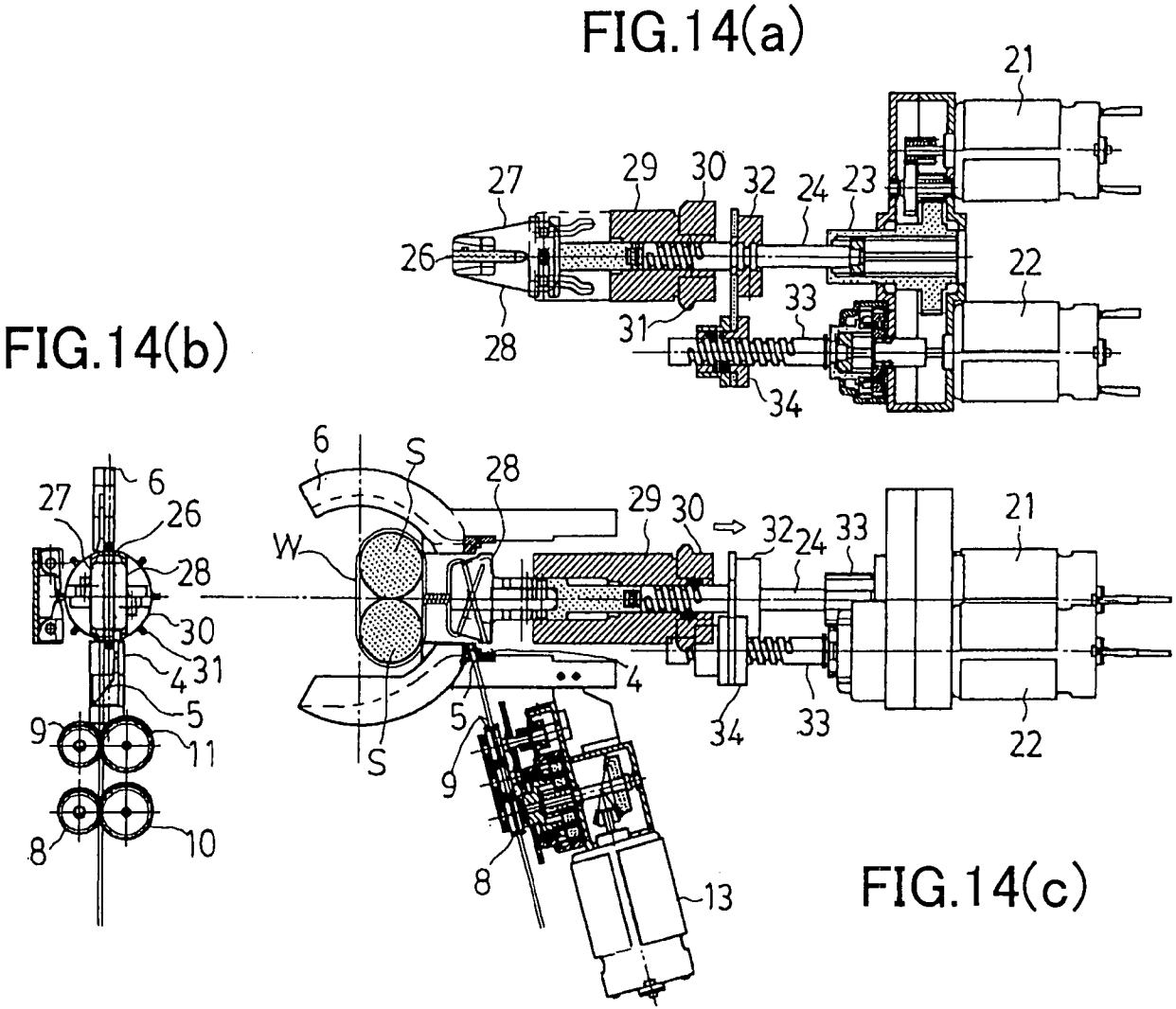
FIGS. 14(*a*), 14(*b*) and 14(*c*) show a state of finishing to twist, FIG. 14(*a*) is a plane sectional view, FIG. 14(*b*) is a front view and FIG. 14(*c*) is a side sectional view.
Figures 15A, 15B, 15C:
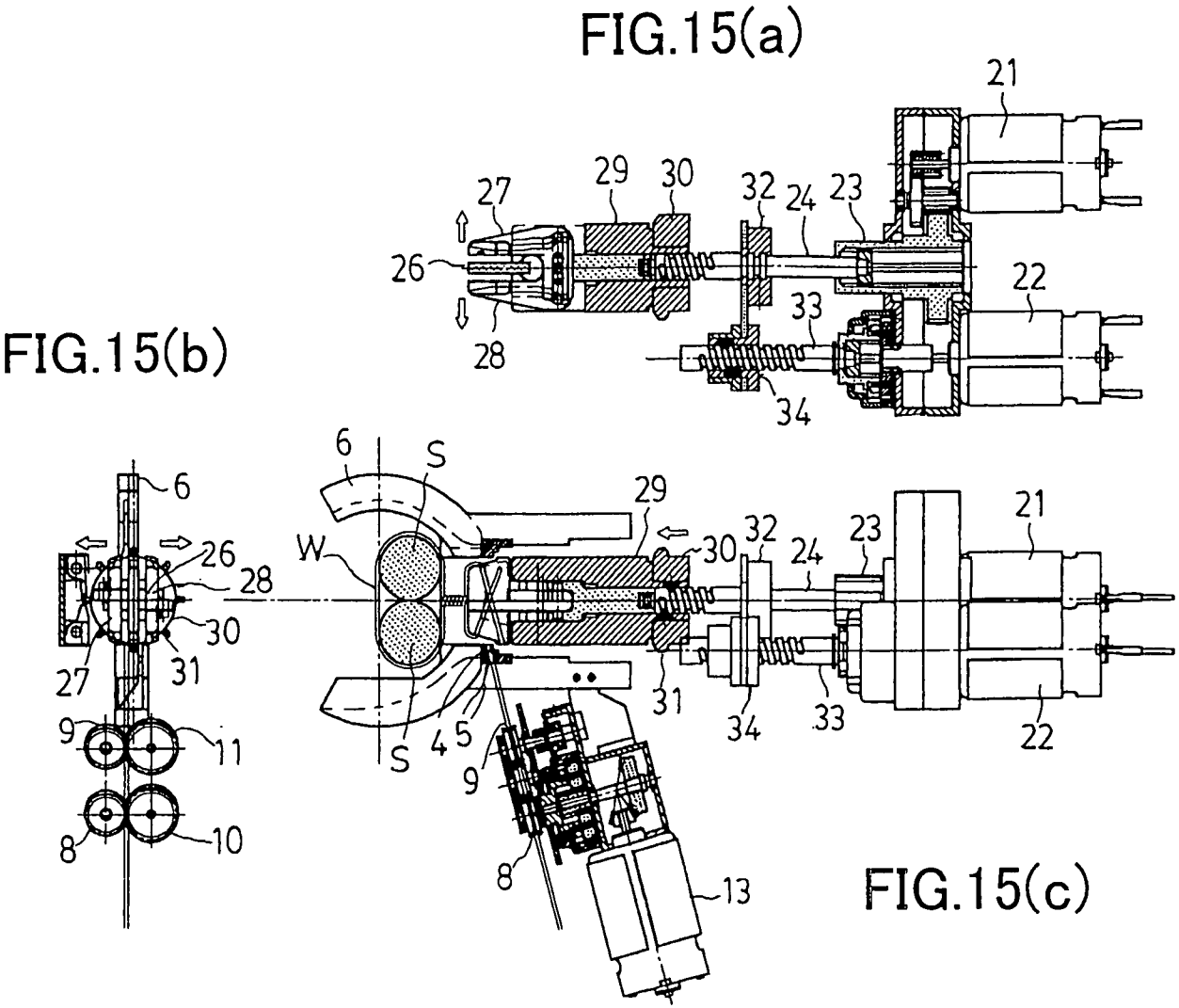
FIGS. 15(*a*), 15(*b*) and 15(*c*) show a step of opening the binding wire, FIG. 15(*a*) is a plane sectional view, FIG. 15(*b*) is a front view and FIG. 15(*c*) is a side sectional view.

Further, when the binding wire clamping apparatus 25 is moved forward by a predetermined distance as shown by FIG. 14(*a*) through 14(*c*), or when the drive current reaches the predetermined upper limit value by increasing the load for driving the twisting motor 21 in finishing to twist the wire, the twisting motor 21 and the sliding motor 22 are stopped to drive. Successively, as shown by FIG. 15(*a*) through FIG. 15(*c*), the twisting motor 21 is rotated reversely, the left and the right clamp plates 27, 28 are opened by moving the sleeve 29 forward, the bound wire W is released and thereafter, the binding wire clamping apparatus 25 is returned to the initial position by controlling the twisting motor 21 and the sliding motor 22 to thereby finish the binding operation of 1 cycle.

Further, the invention is not limited to the above-described embodiment but can variously be modified within the technical range of the invention and the invention naturally covers the modifications.

The application is based on Japanese Patent Application (JP-2002-067449) filed on Mar. 12, 2002 and content thereof is incorporated here by reference.

INDUSTRIAL APPLICABILITY

As has been explained above, the reinforcing bar binding machine of the invention is constituted such that in the step of pulling back the binding wire, the load for driving the feeding motor is monitored and the feeding motor is stopped by detecting the increase in the current of driving the motor when the binding wire is brought into close contact with the reinforcing bar and therefore, the length of the binding wire is automatically adjusted in accordance with the diameter of the reinforcing bar to thereby make the state of finishing to bind the binding wire uniform and also an amount of consuming the binding wire is reduced.

Further, by providing the control means for stopping the feeding motor when the amount of pulling back the wire reaches the reference value in the step of pulling back the wire, when the wire is pulled back in the state in which the front end of the binding is not clamped by the failure in feeding the binding wire, the binding wire is prevented from passing the binding wire feeding mechanism and time and labor of binding again the binding wire can be saved.

The invention claimed is:

1. A reinforcing bar binding machine comprising:

a binding wire feeding mechanism, including a feeding motor for feeding out a binding wire, for feeding the binding wire to form a loop around reinforcing bars;

a clamping mechanism for clamping a front end of the binding wire;

a current detecting circuit for measuring a value of a current for driving the feeding motor; and a control portion for controlling the feeding motor;

wherein the binding wire feeding mechanism is driven and reversely rotated for pulling back the binding wire and for winding the binding wire around the reinforcing bars, and the clamping mechanism is driven and rotated for twisting the binding wire and for binding the reinforcing bar, wherein the current detecting circuit measures the value of the current for driving the feeding motor successively at each unit time in a step of pulling back the binding wire; and wherein the control portion stops the feeding motor when a newest value of the drive current is increased by a predetermined amount from a lowest value of the drive current measured in the step of pulling back the binding wire.

2. The reinforcing bar binding machine according to claim 1, further comprising:

a pulling back amount detecting portion for detecting an amount of pulling back the binding wire, wherein the feeding motor is stopped when a pulling back amount reaches a reference value, in the step of pulling back the binding wire.

3. The reinforcing bar binding machine according to claim 1, further comprising:

a revolution number detecting sensor for detecting a revolution number of the feeding motor; and a timer for starting to measure a drive time, simultaneously with starting the feeding motor, wherein an amount of feeding the binding wire is measured by the revolution number of the feeding motor detected by the revolution number detecting sensor and the drive time measured by the timer, in the step of pulling back the binding wire.

4. The reinforcing bar binding machine according to claim 3, wherein the feeding motor is stopped when the time for driving the feeding motor reaches a reference time of feeding the binding wire, in the step of pulling back the binding wire.

5. The reinforcing bar binding machine according to claim 3, wherein the feeding motor is stopped when the amount of feeding the binding wire reaches a reference feeding amount, in a step of feeding the binding wire.

6. The reinforcing bar binding machine according to claim 1, further comprising:

a revolution number detecting sensor for detecting a revolution number of the feeding motor; and a timer for starting to measure a drive time, simultaneously with starting the feeding motor;

wherein an amount of pulling back the binding wire is measured by the revolution number of the feeding motor detected by the revolution number detecting sensor and the drive time measured by the timer, in the step of pulling back the binding wire.

7. The reinforcing bar binding machine according to claim 6, wherein the feeding motor is stopped when the time of driving the feeding motor reaches a reference time of pulling back the binding wire, in the step of pulling back the binding wire.

8. The reinforcing bar binding machine according to claim 6, wherein the feeding motor is stopped when an amount of pulling back the binding wire reaches a reference pulling back amount, in the step of pulling back the binding wire.

9. The reinforcing bar binding machine according to claim 1, wherein a predetermined length of the binding wire is fed out by driving the feeding motor, after the step of pulling back the binding wire.

10. The reinforcing bar binding machine according to claim 1, wherein a reference time of pulling back the binding wire is shorter than a reference time of feeding the binding wire, and a reference pulling back amount of the binding wire is smaller than a reference feeding amount of the binding wire.

* * * * *